United States Patent [19]

Smith

[11] Patent Number: 4,507,919

[45] **Date of Patent: * Apr. 2, 1985**

[54] FAIL SAFE ACTUATOR

[76] Inventor: Russell G. Smith, 2805 Digby Ave., Cincinnati, Ohio 45220

[ * ] Notice: The portion of the term of this patent subsequent to Jun. 30, 1998 has been disclaimed.

[21] Appl. No.: 379,068

[22] Filed: May 17, 1982

Related U.S. Application Data

[63] Continuation of Ser. No. 120,055, Feb. 11, 1980, abandoned.

[51] Int. Cl.[3] ..... F15B 1/06; F15B 11/15; F15B 13/042

[52] U.S. Cl. ..... 60/404; 60/413; 60/459; 91/446

[58] Field of Search ..... 91/5, 416, 446, 468; 60/413, 407, 412, 415, 404, 459; 251/27, 28

[56] References Cited

U.S. PATENT DOCUMENTS

| | | | |
|---|---|---|---|
| 3,523,489 | 8/1970 | Perkins | 91/416 |
| 3,572,032 | 3/1971 | Terry | 60/404 X |
| 3,645,170 | 2/1972 | Varduxis | 91/416 |
| 3,752,041 | 8/1973 | Smith | 91/416 |
| 3,893,374 | 7/1975 | Hirasawa | 60/407 |
| 4,036,106 | 7/1977 | Athy, Jr. | 60/413 X |
| 4,039,034 | 8/1977 | Wagner | 91/5 X |
| 4,275,642 | 6/1981 | Smith | 91/415 R |

*Primary Examiner*—Irwin C. Cohen
*Attorney, Agent, or Firm*—James D. Liles

[57] ABSTRACT

A fail-safe actuator mechanism has an actuator housing encapsulated within a tank which stores a pressurized fluid media. Ports of the actuator housing are put into selective fluid communication with both the interior and exterior of the encapsulating tank by a valve at selective pressures.

5 Claims, 5 Drawing Figures

FAIL SAFE ACTUATOR

This is a continuation of application Ser. No. 120,055, filed Feb. 11, 1980, and now abandoned.

BACKGROUND

The present invention relates generally to fail-safe actuator mechanisms and more particularly concerns a fail-safe actuator which automatically returns a fluid media controlled valving member to a predetermined position whenever the pressure of the controlling fluid media falls below a predetermined level.

In many situations, it is imperative that a valve member is returned to a predetermined position in the event of a power failure. One highly successful device for insuring the return of such a valving member is shown in applicant's U.S. Pat. No. 3,752,041. This mentioned patent discloses a fluid operated vane actuator with control valve means connected between a source of pressurized fluid and a first side of the actuator. A bypass conduit also communicates with an accumulator tank through a restrictive orifice, and the accumulator tank, in turn, communicates with the second side of the actuator. Whenever a mechanical or electrical failure causes a sudden loss of air pressure, the restrictive orifice produces a disparate flow rate between the accumulator tank and the first side of the actuator on one hand, and the actuator tank and the second side of the actuator on the other hand, the flow to the second side being far greater. Due to the disparate flow rates, the actuator is urged toward the first side and the controlled valve is moved to a closed position.

Another highly successful fail-safe actuator is disclosed in applicant's co-pending application Ser. No. 944,771 filed Sept. 22, 1978, now U.S. Pat. No. 4,275,642. This apparatus discloses an actuator which is entirely enclosed within a steel encapsulating housing to prevent exposure of the actuator to potentially harmful vapors. Pressurized fluid mdeia is communicated directly to a first side of the actuator and indirectly to a second side of the actuator through the interior of the encapsulating member. The interior of the encapsulating member communicates with the second side of the actuator. The steel encapsulating housing thus functions both as a means to insolate the actuator from its environment and as an accumulator tank. Whenever pressure of the fluid media drops suddenly, pressurized fluid stored in the encapsulating housing flows into the second side of the actuator to move a controlled valving member to a closed position.

Frequently, fluid pressure operated systems are designed to completely shut off whenever the pressure of the operating fluid falls below a predetermined level. In some instances, however, it is desirable to use a fail-safe valve which returns a valving member to a predetermined position in a system which does not have a shut off pressure level. Since the above mentioned fail-safe devices are designed to operate in response to sudden pressure decreases, they are ineffective in situations in which the fluid pressure "sags" or drops slowly.

Moreover, it is sometimes desirable to cycle a fail-safe valving member repeatedly within a short period of time. Balanced air systems, like those of the fail-safe actuators discussed above, have time limitations for repeated cycling.

SUMMARY OF THE INVENTION

In accordance with the preferred form of the invention, a fail-safe actuator arrangement is provided which includes an actuator enclosed entirely within an encapsulating tank. A four-way piloted control valve is also enclosed in the encapsulating tank. External fluid pressure is piped through a check valve to the encapsulating tank and is also directly connected to the pilot of the four-way piloted control valve.

When fluid pressure is applied, the encapsulating tank and the pilot of four-way control valve are pressurized. The application of this pressure positions the four-way pilot valve so that simultaneously encapsulating tank pressure is directly connected to one port of actuator while other port of actuator is exhausted outside of encapsulating tank.

At a loss of pressure, a predetermined reduction of pressure, check valve closes maintaining pressure within tank, and the four-way pilot valve repositions so that encapsulating tank pressure is directly connected to other port of actuator while opposite port of actuator is exhausted outside of encapsulating tank. Thus, application of pressure media rotates actuator in one direction, while reduction or loss of pressure rotates actuator in other direction.

BRIEF DESCRIPTION OF THE DRAWINGS

There will now be given a detailed description to be read with reference to the accompanying drawings of an apparatus which is the preferred embodiment of the invention and which has been selected to illustrate this invention by way of example. In the accompanying drawings.

Although the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appending claims.

DETAILED DESCRIPTION OF THE PREFERRED EMBODIMENT

Figure 1:
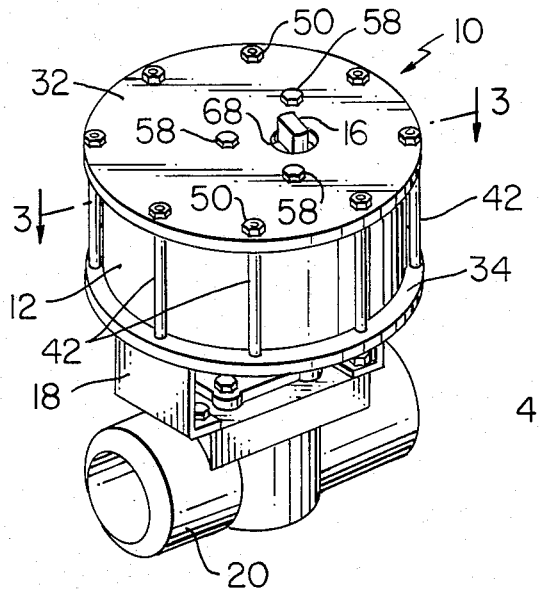
FIG. 1 is a perspective view of a fail-safe actuator and valve utilizing a form of the present invention.

Referring now to the drawings and to FIG. 1 in particular, there is shown a fail-safe actuator 10 which includes an encapsulating tank 12 in which an actuator 14 (see FIG. 2, not shown in FIG. 1) is disposed. The actuator 14 imparts a rotary motion to a driven shaft member 16. The driven shaft member 16 is adapted to actuate a device, such as a valve, between the first and second positions. The illustration of FIG. 1 shows the encapsulating tank 12 (which contains the actuator 14) secured to a mounting bracket 18. The mounting bracket 18 is, in turn, secured to a valve 20 by conventional means.

Figure 2:
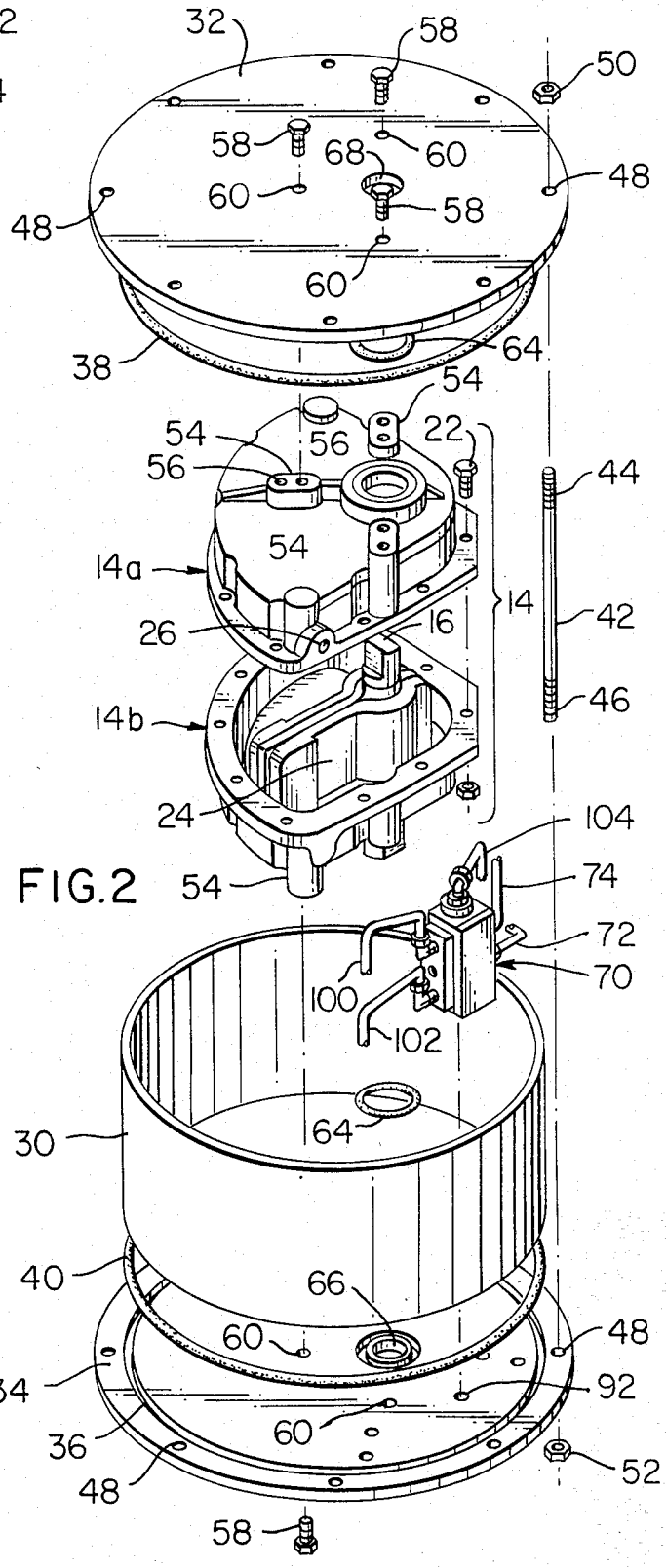
FIG. 2 is an exploded perspective view of the component parts of the actuator of FIG. 1.

Turning now to the exploded view of FIG. 2, it is seen that the actuator 14 is constructed of upper and lower housing portions 14*a* and 14*b* respectively, suitably interconnected by suitable fasteners 22. The actuator 14 contains a vane 24 which is rigidly secured to the driven shaft member 16 to insure common rotation of the driven shaft 16 with the vane 24 whenever the vane is rotated within the housing 14.

The upper housing portion 14*a* contains a pair of ports 26 and 28 (port 28 being obscured in FIG. 2) through which pressurized fluid media, as for example air, may be introduced to effectuate rotary movement of the vane 24 and driven shaft 16. For example, pressurized fluid media may be introduced into port 26 to create a pressure differential across vane 24, and to urge the vane 24 away from port 26 toward port 28 about the pivitol axis of driven shaft 16. Conversely, the introduction of pressurized media into port 28 tends to urge the vane 24 away from that port 28 and toward port 26. Vane actuators of this type are known in the art and form no part, per se, of the present invention. Furthermore, the structural details of the illustrated actuator may be found in my U.S. Pat. No. 3,752,041.

The encapsulating tank 12 may be constructed of a hollow steel cylindrical shaped side wall member 30 and top and bottom steel members 32 and 34 respectively. In the illustrated embodiment, both the top wall member 32 and bottom wall member 34 have annular grooves which receive peripheral edges of the cylindrical shaped side wall member 30. Annular groove 36 in bottom wall member 34 is illustrated. O-rings 38 and 40 are received within the annular grooves of the top and bottom wall members. The top and bottom wall members 32 and 34 are secured to the side wall member 30 and to each other through the agency of tie-rods 42 which are threaded at their upper and lower ends 44 and 46. The tie-rods 42 project axially through aligned tie-rod receptive openings 48 adjacent the periphery of the top and bottom wall members 32 and 34 at locations intermediate the annular groove 36 and the peripheral edge of the top and bottom wall members. Nuts 50 and 52 threadedly receive the threaded ends 44 and 46 of the tie-rods 42 to secure the top and bottom wall members 32 and 34 in an air-tight, pressure resistant relationship with respect to the side wall member 30.

The actuator 14 is secured to either the inner surface of top wall member 32 or the inner surface of bottom wall member 34 or both. The upper and lower portions 14*a* and 14*b* of the actuator housing contain a plurality of upstanding integral bosses 54 (only one of which is shown on the lower portion 14*b*). These bosses 54 contain internally threaded openings 56 which receive bolts 58 which are axially advanced through openings 60 in the top and bottom wall members 32 and 34.

The driven shaft 16 projects through the encapsulating tank 12 through both the top wall member 32 and the bottom wall member 34. The projection of driven shaft 16 through the bottom wall member 34 extends through aperature 66 and permits mechanical connection between the driven shaft 16 and the stem of valve 20. The projection of driven shaft 16 through the top wall member 32 extends through aperture 68 and permits the actuator and connected valve member to be controlled manually by a hand wheel, lever or the like.

Suitable means such as O-rings 64 are provided for establishing an air tight seal between the interior of the encapsulating tank 12 and the projecting portions of the driven shaft 16. Similarly, suitable sealing means are provided for establishing an air tight sealing relationship between the anchoring bolts 58 and the actuator housing secured thereby.

Figure 3:
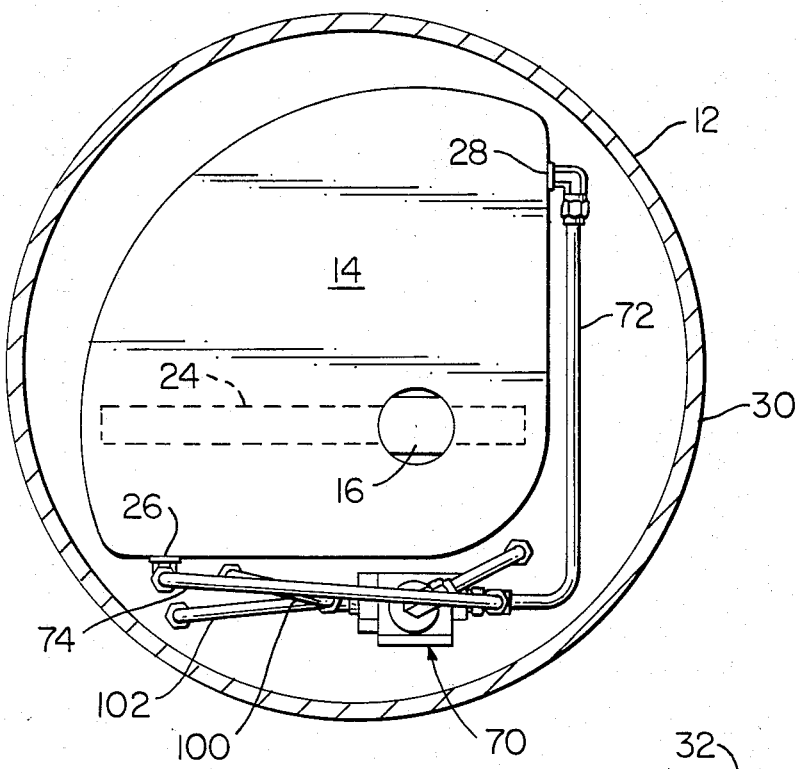
FIG. 3 is a plan view, taken along line 3—3 in FIG. 1, illustrating the actuator and valving unit disposed with an encapsulating tank, with details omitted for clarity of illustration.

FIG. 3 depicts the interior of the encapsulating tank 12 and the relationship between the actuator 14 and a valving unit 70. The valving unit 70 is connected to ports 28 and 26 of upper actuator housing 14*a* by fluid conduits 72 and 74 respectively.

Figure 4:
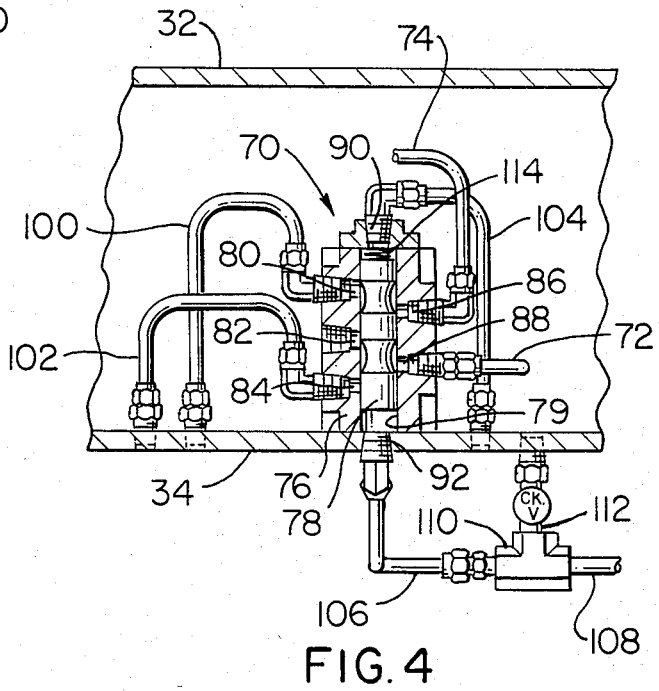
FIG. 4 is an elevational view, partially in cross section, of the valving unit of FIG. 3.
Figure 5:
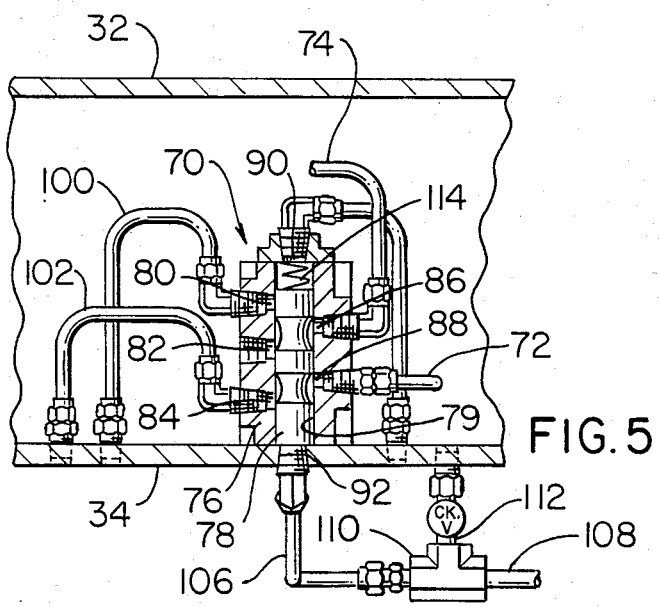
FIG. 5 is a cross sectional view of the valving unit similar to FIG. 4, but illustrating the valving unit in a different position.

As appreciated from a viewing of FIGS. 4 and 5, the valving unit 70 includes a four way pilot valve with a housing 76 and an axially movable control member 78 contained within an internal bore 79 of the housing 76. The valve housing 76 contains five ports 80, 82, 84, 86, and 88 axially spaced along the housing 76 as well as two end ports 90 and 92, all communicating with the internal bore 79. Port 86 of the valve communicates to actuator port 26 through fluid conduit 74 which lateral port 88 communicates through fluid conduit 72 to actuator port 28. Each of the ports 86 and 88 in turn selectively communicate with port 82 which extends through the housing 76 to the interior of the encapsulating tank 12 in accordance to the axial position of the control member 78.

Port 86 also selectively communicates with port 80 which, in turn, communicates with the encapsulating tank 12 exterior through a fluid conduit 100 and port 88 likewise selectively communicates with the exterior of encapsulating tank 12 through port 84 and fluid conduit 102.

End port 90 is in fluid communication with the encapsulating tank exterior through a fluid conduit 104 and end port 92 is in fluid communication with a pressurized fluid source through fluid conduit 106.

Pressurized fluid media, as for example air, is directed from a source to a fluid conduit 108 where it enters conduit 106 through a by-pass T-section 110. T-section 110 also has a direct communication with the interior of encapsulating tank 12 through a fluid conduit 112 which contains a unidirectional flow control device, such as for example, a check valve.

A spring 114 located proximal to the valve end port 90 urges the control member 78 to the position illustrated in FIG. 5. In this position, actuator port 28 communicates with the exterior of the tank through conduit 72, ports 88 and 84, and conduit 102. In this same position, actuator port 26 communicates with the interior of encapsulating tank 12 through conduit 74, ports 86 and 82.

When pressurized media flows from its source through conduit 108 and into T-section 110, part of the media flows into conduit 112 through the unidirectional flow means into the encapsulating tank 12. This pressurized media flow is also communicated to valve port 92 where the fluid is applied to an end portion of the control member 78. The resultant force overcomes the bias of spring 114 and moves the control member axially to the position depicted in FIG. 4 to establish fluid communication between ports 82 and 88. Simultaneously, the control member 78 establishes fluid communication between ports 86 and 80. At the same time, communication between valve ports 86 and 82 and 88 and 84 is terminated.

Whenever the pressure of the fluid media falls below a predetermined level, determined in the preferred embodiment by spring 114, the control member 78 is shifted to the position of FIG. 5. It is thus seen that the valving unit 70 selectively provides fluid communication between one of the ports 26 and 28 and the interior of the encapsulating tank. The other of the ports 26 and 28 is exhausted to the exterior of the tank 12.

It is also seen that the encapsulating tank 12 of the preferred embodiment is multifunctional. It protects both the actuator and valving unit from mechanical and chemical damage. It also serves as an accumulator tank for the storage of pressurized media, which media serves to effectuate movement of the actuator whenever the valving unit establishes selective fluid communication. Since the valving unit is biased to a predetermined position, the pressurized media in the encapsulating tank insures movement of the valve member whenever the pressure of the media source falls below a predetermined level.

Thus it is apparent that there has been provided, in accordance with the invention, a fail-safe actuator that fully satisfies the objects, aims and advantages set forth above. While the invention has been described in conjunction with a specific embodiment thereof, it is evident that alternatives, modifications, and variations will be apparent to those skilled in the art in light of the foregoing description. Accordingly, it is intended to embrace all such alternatives, modifications, and variations as fall within spirit and broad scope of the appended claims.

What is claimed is:

1. A fail safe actuator, comprising:

(a) encapsulating means for providing an air-tight chamber isolated from the external environment, said air-tight chamber containing a pressurized fluid isolated from ambient pressure;

(b) an actuator housing completely disposed within said air-tight chamber, said housing having first and second ports, each of said first and second ports selectively communicating with both the air-tight chamber and the ambient environment;

(c) an actuating element movably disposed within said actuator housing, said actuating element being movable to a first position in response to the introduction of a pressurized fluid media into said first actuator housing port and movable to a second position in response to the introduction of pressurized fluid media into said second actuator housing port;

(d) a rotary drive shaft extending between the air-tight chamber and the ambient environment through said encapsulating means, said drive shaft being interconnected to said actuating element and being rotatably movable in response to movement thereof;

(e) a rotary seal between said rotary drive shaft and said encapsulating means, said rotary seal being operative to maintain a pressure differential between the air-tight chamber and the ambient pressure;

(f) a four-way control valve disposed within said air-tight chamber, said control valve being movable between a first valve position establishing fluid communication between said first port and the air-tight chamber and a second valve position establishing fluid communcation between the second port and the air-tight chamber, said control valve establishing fluid communication between one of said first and second actuator housing ports and the ambient environment whenever the other of said first and second actuator ports is in fluid communication with the air-tight chamber;

(g) means for biasing said control valve toward said first valve position;

(h) unidirectional flow means for permitting flow of pressurized fluid media to said air-tight chamber; and (i) means for directing a pressurized fluid media to both the control valve and the unidirectional flow means, said directing means serving to pressurize the air-tight chamber and to move the control valve to the second position against the resilient biasing means whenever the pressurized fluid media exceeds a predetermined pressure, the control valve being movable to said first position only when the pressurized fluid media falls below the predetermined level, whereby the entire actuator housing and control valve are protected in the air-tight chamber from impact and environmental damage and the control valve is cyclicly movable in response to pressure fluctuations in a pressurized fluid media above and below the predetermined pressure to control the position of the drive shaft.

2. A fail-safe actuator as recited in claim 1 wherein said valve includes a valve housing and a control member axially movable within the housing, said valve being operative to selectively establish fluid communication between the actuator housing ports, the interior of the air-tight chamber, and the exterior of the air-tight chamber.

3. A fail-safe actuator as recited in claim 1 wherein said unidirectional flow means includes a check valve.

4. A fail-safe actuator as recited in claim 3 wherein said means for providing fluid communication between said valve and the pressurized media source and between the unidirectional flow means and the pressurized media source includes a T-shaped connecting element with three joining connective legs in common fluid communication with each other, one of said legs being in fluid communication with the valve, another of said legs being in fluid communication with the interior of the air-tight chamber through the check valve, and the other of said legs being in fluid communication with the pressurized media source.

5. A fail-safe actuator as recited in claim 4 wherein said biasing means is a spring.

* * * * *